United States Patent [19]

Woodhull, Jr.

[11] 4,209,062

[45] Jun. 24, 1980

[54] HEAT EXCHANGER CONSTRUCTION

[75] Inventor: Ivan D. Woodhull, Jr., Flat Rock, Mich.

[73] Assignee: Karmazin Products Corporation, Wyandotte, Mich.

[21] Appl. No.: 876,669

[22] Filed: Feb. 10, 1978

[51] Int. Cl.[2] ..... G05D 15/00

[52] U.S. Cl. ..... 165/38; 165/76; 165/175; 123/41.33; 137/454.6

[58] Field of Search ..... 123/41.33, 41.1; 165/175, 38, 76; 137/454.6

[56] References Cited

U.S. PATENT DOCUMENTS

| | | | |
|---|---|---|---|
| 1,094,543 | 4/1914 | Donnelly | 137/454.6 |
| 1,405,525 | 2/1922 | LeCain | 137/454.6 |
| 1,690,501 | 11/1928 | Potts | 165/38 |

FOREIGN PATENT DOCUMENTS

| | | | |
|---|---|---|---|
| 813272 | 5/1937 | France | 165/38 |

OTHER PUBLICATIONS

Excerpt from Karmazin Products Corporation's Drawing 212-183.

*Primary Examiner*—Albert W. Davis
*Assistant Examiner*—Margaret A. Focarino
*Attorney, Agent, or Firm*—Harness, Dickey & Pierce

[57] ABSTRACT

There is disclosed herein a heat exchanger construction of the finned fluid conduit type which includes an integral pressure actuated by-pass fluid assembly adapted to enable fluid being circulated through the heat exchanger to by-pass the core portion thereof when header pressure exceeds a predetermined pressure. The heat exchanger of the present invention comprises an inlet header, outlet header, and interconnecting heat exchanger core assembly and a continuous by-pass fluid conduit member extending therebetween in which is disposed a pressure responsive valve adapted to control fluid flow between the inlet and outlet headers. The continuous fluid by-pass conduit is designed to have a pressure relief valve removably positioned internally thereof and preferably will have one end extending completely through one of the headers which end may be provided with a suitable removable closure member to facilitate installation and/or replacement of the pressure relief valve.

26 Claims, 7 Drawing Figures

HEAT EXCHANGER CONSTRUCTION

BACKGROUND AND SUMMARY OF THE INVENTION

The present invention relates generally to heat exchangers and more specifically to such heat exchangers having a pressure responsive by-pass assembly integral therewith.

Heat exchangers of the finned conduit type are employed for cooling or otherwise transferring heat between two fluids generally one of which is circulated internally through conduits provided in the heat exchanger core and the other being passed over the exterior of the conduits and associated heat radiating fins. Such heat exchangers are commonly employed in heavy construction machinery as well as other apparatus for use in cooling oil, hydraulic fluid or the like. In such applications the oil may have a relatively high viscosity when cool such as at startup of the equipment and become thinner as it is warmed during use. This high viscosity may cause higher than desired pressure in the inlet header of such oil coolers due to the viscous resistance of oil flow through the relatively small passages in the heat exchanger core. Further, the resistance may prevent a sufficient amount of oil from being circulated through the system which in an extreme case could result in excessive equipment wear. Accordingly, it is desirable to provide pressure responsive by-pass means to allow the high viscosity oil to by-pass the heat exchanger core. Such a by-pass means may also operate to prevent unnecessary cooling of the oil thereby assisting the apparatus in reaching a steady state operating temperature more rapidly. Such an arrangement offers a further advantage in that should the heat exchanger core passage become constricted or plugged due to contaminants in the oil or damage to the core portion, the pressure responsive by-pass means will operate to insure a sufficient fluid flow to prevent equipment damage due to lack of oil.

In one arrangement for supply such a by-pass arrangement of which applicant is aware, the heat exchanger is constructed with elongated inlet and outlet headers each havng a fitting provided thereon. A self-contained pressure relief valve is provided having one end threadedly installed in one of the fittings. Generally, a flexible host fitting is then threaded into the other end of the pressure relief valve to which a hose may be secured such as by means of a conventional strap clamp. A similar hose fitting may be threaded into the other header fitting and the other end of the hose secured thereto again by a conventional hose clamp.

While this arrangement provides an effective pressure relief by-pass means, it is relatively expensive to install in terms of both components and labor. Further, the need for the numerous fittings, each being interconnected increases the chances of leaks occurring such as by loosening of the fittings due to vibration or the like. Also, as the hose is generally of the rubber neoprene or other synthetic composition material, it is subject to degradation due to the elements as well as vibrational wear should it touch another surface during operation of the equipment. Thus, periodic inspections and/or replacements of these hoses is required.

Accordingly, the present invention provides an improved heat exchanger particularly suited for use as an oil cooler which has an integral pressure responsive by-pass assembly provided thereon. This by-pass assembly includes a continuous fluid conduit extending between and in fluid communication with the inlet and outlet headers. A pressure relief valve is removably installed within the conduit and operates to prevent fluid passage therethrough unless a predetermined pressure differential occurs between the two headers. Preferably, the one or more of openings provided in the headers which receive the end portions of the by-pass conduit are formed by tee drilling, which is a form of metal spinning so as to provide an outwardly projecting collar portion around the periphery of the opening. This collar operates to increase the surface area opposing the by-pass conduit sidewall thereby facilitating brazing of the joint therebetween and significantly reducing the possibility of leaks developing or other failures occurring. Additionally, in order to allow installation of the pressure relief valve subsequent to completion of the heat exchanger assembly operation, the fluid by-pass conduit may have one end extending through one of the headers and a suitable closure or plug member removably installed therein. This feature also enables rapid replacement of the pressure relief valve if necessary.

Additional features and advantages of the present invention will become apparent from the following description of the preferred embodiments taken in conjunction with the drawings and claims appended hereto.

DESCRIPTION OF THE PREFERRED EMBODIMENTS

Figures 1, 2, 3, 4, 5, 6, 7:
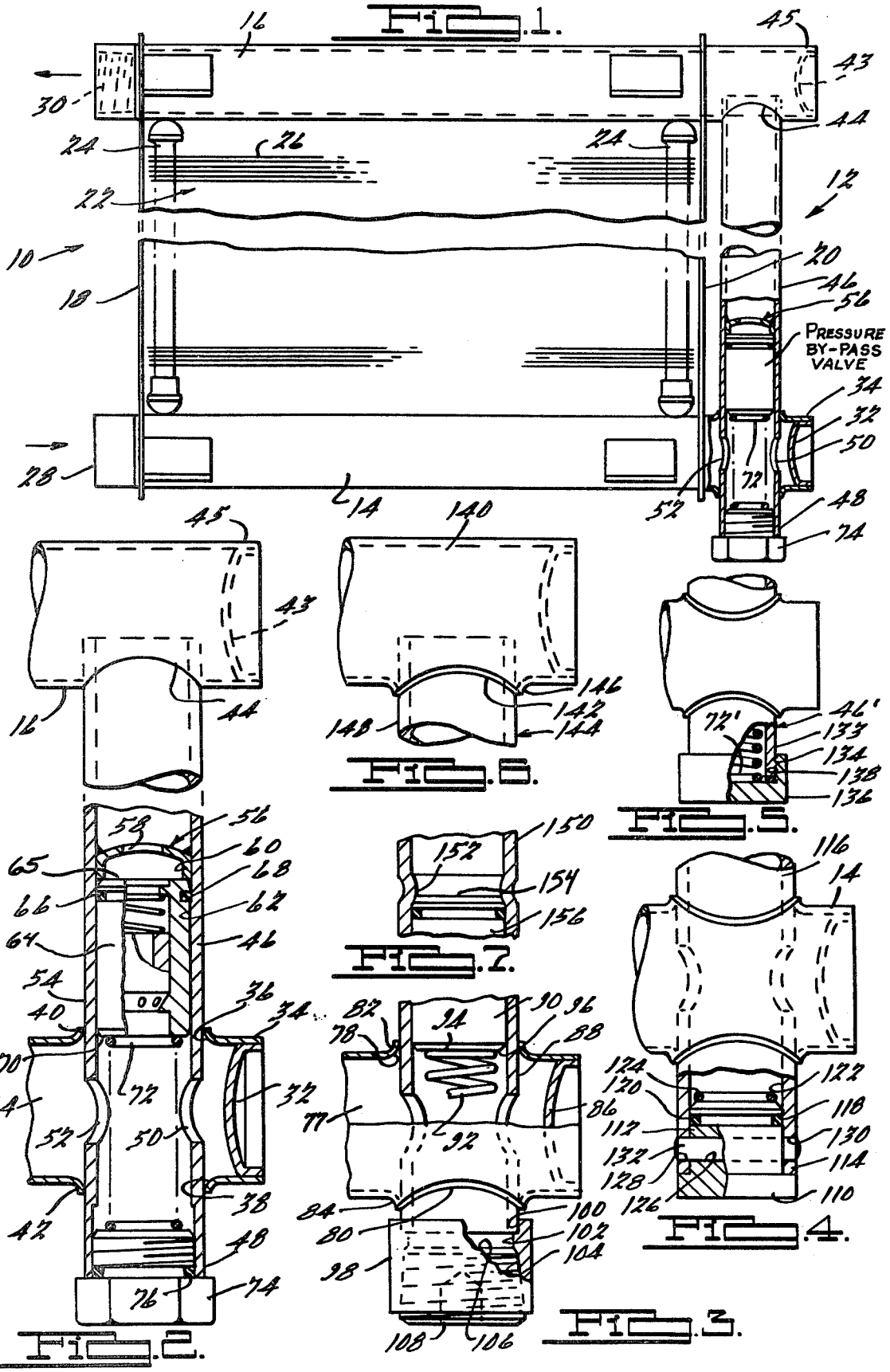
FIG. 1 is a side elevational view of a heat exchanger in accordance with the present invention having an integral pressure responsive by-pass assembly provided thereon.
FIG. 2 is an enlarged fragmentary detail view of the pressure responsive by-pass assembly illustrated in FIG. 1.
FIG. 3 is an enlarged fragmentary detail view of the lower portion of the by-pass assembly illustrating another embodiment thereof.
FIG. 4 is a view similar to that of FIG. 3 but illustrating yet another embodiment.
FIG. 5 is a view similar to that of FIGS. 3 and 4 but illustrating yet another embodiment thereof.
FIG. 6 is an enlarged fragmentary detail view of the upper portion of the by-pass assembly illustrating an alternative connection arrangement in accordance with the present invention.
FIG. 7 is an enlarged fragmentary detail view of a mid-portion of the by-pass conduit of the present invention illustrating an alternative valve stop means.

Referring now to the drawings and in particular to FIG. 1, there is illustrated therein a heat exchanger in accordance with the present invention indicated generally at 10 having an integral fluid by-pass assembly 12 associated therewith. Heat exchanger 10 comprises an inlet header 14, an outlet header 16 spaced from inlet header 14, and arranged in substantially parallel relationship therewith and a pair of spaced apart frame members 18 and 20 extending therebetween adjacent opposite ends of inlet and outlet headers 14 and 16. A heat exchanger core assembly 22 is disposed between inlet and outlet headers 14 and 16 and is in fluid communication therewith, the core assembly comprising a plurality of relatively small diameter fluid conduits 24 extending generally perpendicular to the longitudinal axis of inlet and outlet headers 14 and 16 and being surrounded by a plurality of fins 26 extending substantially parallel to the longitudinal axis of inlet and outlet headers 14 and 16. Inlet header 14 has an opening 28 adjacent one end thereof which is adapted to be connected to a fluid supply line and oulet header 16 has a similar opening 30 adapted to be connected to a discharge line.

As best seen with reference to FIG. 2, inlet header 14 is provided with a suitable plug 32 interfitted within the end portion 34 thereof and has a pair of diametrically opposed openings 36 and 38 provided in the sidewall portion thereof adjacent end portion 34. Preferably, openings 36 and 38 will be formed by a tee drilling operation. The tee drilling operation as used herein refers to a drilling operation employing a specially designed bit and associated driving apparatus in which the bit is caused to pierce the member to be tee drilled and thereafter is drawn outward while a portion of the bit operates in a manner to outwardly deform a portion of the workpiece being drilled so as to form an outwardly projecting annular collar 40 and 42 around the periphery of the respective openings 36 and 38. The tee drill bit is designed to form this collar by a process which may best be described as a metal spinning operation.

Similarly, outlet header 16 has a suitable plug 43 sealingly interfitted within the terminal end portion 45 thereof and adapted to prevent fluid leakage and also a single opening 44 in the sidewall portion thereof adjacent end portion 45.

The diametrically opposed openings 36 and 38 in the inlet header and the single opening 44 in the sidewall portion of the outlet header are positioned so as to be in alignment when the heat exchanger is finally assembled.

A fluid by-pass conduit in the form of an elongated cylindrical hollow member 46 is provided extending into opening 44 provided in the outlet header 16 and through diametrically opposed openings 36 and 38 provided in inlet header 14. The fluid by-pass conduit member 46 is of a sufficient length so as to allow one end 48 thereof to protrude outwardly from the bottom of inlet header 14 and is preferably sealed within the respective openings 36, 38, and 44 in any suitable manner such as and preferably by brazing. Fluid by-pass conduit member 46 has a pair of diametrically opposed openings 50 and 52 provided in the sidewall portion adjacent thereof which place the interior of fluid by-pass conduit member 46 in fluid communication with the interior of inlet header 14. The opposite end of fluid by-pass conduit member 46 is interfitted within opening 44 provided in outlet header 16 and is spaced from the opposite inner wall thereof so as to allow fluid flowing through fluid by-pass conduit member 46 to flow freely into outlet header 16. As illustrated in FIG. 2, peripheral collars 40 and 42 surrounding diametrically opposed openings 36 and 38 operate to increase the surface area opposing the sidewall 54 of fluid by-pass conduit member 46. This increased opposed surface area greatly facilitates fabrication of a strong, durable seal therebetween which is easily able to withstand header pressures by high volume production techniques such as oven brazing.

Stop means 56 are secured within the fluid by-pass conduit member intermediate the inlet and outlet headers and comprises a ring-like member having a relatively large diameter central opening 58 provided therein and an annular flange portion 60 engaging the interior sidewalls 62 of fluid by-pass conduit member 46. Preferably, stop means 56 will be secured to sidewall 62 of fluid by-pass conduit member 46 by brazing although any other suitable means may be easily employed such as by welding or the like. A pressure relief valve 64 is disposed within the fluid by-pass conduit member and has an upper end portion 65 engaging annular flange portion 60 of the stop means 56. A suitable O-ring 66 is provided which is seated within a groove 68 provided on pressure relief valve 64 which sealingly engages sidewall 62 and operates to prevent fluid leakage around pressure relief valve 64. As illustrated, stop means 56 will be positioned within the fluid by-pass conduit member at a location so as to insure that the bottom portion 70 of pressure relief valve 64 will be located above the diametrically opposed openings 50 and 52 provided in fluid by-pass conduit member 46. In order to retain the pressure relief valve 64 in engaging relationship with stop means 56, a resilient member in the form of a helical coil compression spring 72 is provided having one end engaging the bottom portion 70 of the pressure relief valve 64. The other end of spring 72 engages a threaded closure member or plug 74 which is threadedly installed within the lower end portion 48 of the fluid by-pass conduit member 46. As shown therein, plug member 74 is provided with a suitable seal 76 which engages the terminal end portion of the fluid by-pass conduit member so as to effectively seal the end opening against any fluid leakage therefrom. Thus, in operation the fluid will be supplied to inlet header 14 via a supply line connected to the inlet opening 28 and under normal operating conditions the fluid will flow through the plurality of heat exchanger conduits 24 to the outlet header 16 whence it will be transferred back to the apparatus via a discharge line. However, upon startup, when the oil viscosity may be high due to the lower temperature thereof, excessive pressures may develop within the inlet header 14 due to the oil's natural resistance to flow through the relatively small diameter heat exchanger fluid conduits 24. Pressure relief valve 64 will operate in response to this increased pressure level to open thereby allowing fluid to flow through the diametrically opposed openings 50 and 52 provided in fluid by-pass conduit member 46, through pressure relief valve 64 and through opening 58 provided in stop means 56 thence to the outlet header 16 and the discharge line back to the equipment. Thus, oil starvation of the equipment is avoided until such time as the fluid becomes sufficiently warm to allow the pressure within the inlet header to drop thereby allowing the pressure relief valve to again close sealing off the fluid by-pass conduit member and causing the fluid to flow through the heat exchanger core 22.

Referring now to FIG. 3, there is illustrated another embodiment of a by-pass assembly portion of a heat exchanger in accordance with the present invention. As seen therein, and similar to that described above, an inlet header 77 is provided with a pair of diametrically opposed openings 78 and 80 each having a peripheral outwardly extending collar portion 82 and 84 surrounding the respective openings and a suitable plug means 86 interfitted within the end portion thereof. A fluid by-pass conduit member 88 extends through the diametrically opposed openings 78 and 80 and has a pressure relief valve 90 disposed interiorly thereof. A resilient member 92 is provided therein having an end portion 94 engaging the lower or bottom portion 96 of the pressure relief valve so as to maintain it in position against suitable stop means disposed thereabove.

In this embodiment, fluid by-pass conduit member 88 is slightly shorter than that illustrated in FIG. 2 and has a nipple 98 affixed thereto. As seen, the nipple comprises a generally cylindrically shaped member having an opening 100 extending inward from the upper end thereof of a diameter substantially equal to the outside diameter of the fluid by-pass conduit member 88 and adapted to receive the terminal end portion thereof. A reduced diameter portion 102 communicates between this opening and a threaded portion 104 in which is disposed a threaded plug 106 which operates to seal the lower end portion of the fluid by-pass conduit as well as to form a seat for the lower end of resilient member 92 so as to maintain pressure relief valve 90 in position. A hexagonal opening 108 is provided in the plug member so as to accommodate an allen wrench for removal of the plug as desired. Preferably, both the threads of the plug and the nipple will be of the tapered variety so as to form a mutual sealing engagement therebetween.

FIG. 4 illustrates yet another embodiment of a closure member which in this case comprises a plug 110 of a generally cylindrical shape and having a reduced diameter portion 112 which is adapted to fit within the lower end portion 114 of a fluid by-pass conduit member 116. Fluid by-pass conduit member 116 is substantially identical to members 46 and 88 described above and therefore further description thereof is believed unnecessary. An annular groove 118 is provided adjacent the inner end of this reduced diameter portion and is adapted to receive a suitable O-ring 120 or other suitable sealing means so as to form a sealing engagement with the interior wall portion 122 of fluid by-pass conduit member 116. The inner end portion of plug 110 provides a seat for a coil spring 124 which operates to maintain a pressure relief valve in position interiorly of fluid by-pass member 116. A diametrically extending passage 126 is provided through the reduced diameter portion spaced from the annular groove and alignable with a pair of diametrically opposed openings 128 and 130 provided adjacent the end portion 114 of the fluid by pass conduit 116. In order to retain the plug member within the fluid by-pass conduit member, a pin 132 is provided which may be press fitted into the diametrically opposed openings 128 and 130 and through passage 126 provided in the plug 110 thereby operating to removably secure the plug member within fluid by-pass conduit member 116.

Yet another embodiment of the present invention is illustrated in FIG. 5 which embodiment is very similar to that illustrated in FIG. 2 and hence corresponding portions thereof are illustrated by like numerals primed. In this embodiment, the terminal end portion 133 of the fluid by-pass conduit member 46' is provided with external threads 134 along the outer circumference thereof and a plug member 136 is provided having internal threads 138 adapted to cooperate therewith so as to sealingly close off the end portion thereof. As before, plug member 136 operates to provide a seat for the lower end of the helical coil spring 72' biasing the pressure relief valve into position within the fluid by-pass conduit member 46'.

Referring now to FIG. 6, there is illustrated yet another embodiment of an outlet header 140 having a modified opening 142 within which a fluid by-pass conduit member 144 is secured. In this instance, opening 142 is provided in outlet header 140 by means of a tee drilling operation so as to form a peripheral collar 146 which projects outwardly thereof and is adapted to engage the outer sidewall portions 148 of fluid by-pass conduit member 144. As previously mentioned, this increased surface area of mutual engagement between outlet header 140 and the fluid by-pass conduit member 144 assures that a strong, secure, durable seal will be obtained therebetween such as by a brazing operation as previously referred to.

Referring now to FIG. 7, there is illustrated therein a portion of a modified fluid by-pass conduit member 150 having alternative stop means for limiting the longitudinal movement of the pressure relief by-pass valve provided therein. In this embodiment, fluid by-pass conduit member 150 is indented or inwardly deformed so as to form an annular indentation 152 therearound which engages the end portion 154 of a pressure relief by-pass valve 156 so as to prevent axial movement thereof within fluid by-pass conduit member 150.

The heat exchanger of the present invention may be easily assembled by first positioning the inlet header 14 and assembling thereto side frame member 20 and assembling the core 22 comprising the plurality of tubular conduits. Thereafter outlet header 16 may then be assembled to this subassembly and thereafter side frame member 18 may then be assembled to this subassembly. Thereafter, fluid by-pass conduit member 46 may be inserted through diametrically opposed openings 36 and 38 provided in the inlet header 14 and the terminal end portion thereof inserted within the outlet header opening 44. Suitable copper paste and/or wire may then be positioned around the joints and the thus assembled heat exchanger subjected to a brazing operation so as to deposit brazing material around the various joints to create a secure sealed heat exchanger. Once the various joints have been brazed by means of the oven brazing operation, the pressure relief valve may then be installed within the fluid by-pass conduit, the spring inserted therein and a suitable closure member of any type illustrated attached thereto.

Thus, as described herein, the present invention provides an extremely strong, durable heat exchanger which will find multiple applications for use as an oil cooler having integral pressure responsive by-pass means provided therein which offer not only a reduced number of joints which present possible points of leakage but also provides a substantially lower cost assembly. The use of the tee drilling operation to form the openings through which the fluid by-pass conduit member extends serves to greatly assist the integrity of the joints thus formed by providing a greater surface area opposing the sidewall portions of the fluid by-pass conduit which may be sealed by the brazing material.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. In a heat exchanger having an inlet header, an outlet header, a core assembly comprising a plurality of restricted fluid passageways extending between said inlet and outlet headers, and heat radiating fins surrounding said plurality of fluid passageways, an integral pressure responsive by-pass means comprising:

a continuous elongated one piece hollow member extending between and interconnecting said inlet and outlet headers;

a generally cylindrically shaped stop member secured within said hollow member between said inlet and outlet headers, said stop member having an opening therein through which fluid may flow;

a self-contained pressure relief valve disposed entirely within said hollow member between said inlet and outlet headers and being operative to allow fluid flow between said inlet and outlet headers in response to a pressure differential between said inlet and outlet headers greater than a predetermined magnitude, a resilient biasing member engaging one end of said pressure relief valve and being operative to bias the other end of said pressure relief valve into engagement with said stop member;

opening means provided in said heat exchanger for enabling said pressure relief valve to be inserted into said hollow member; and removable closure means for sealingly closing said opening means.

2. A heat exchanger as set forth in claim 1 wherein said outlet header is provided with a by-pass opening in a sidewall thereof and said inlet header is provided with at least one by-pass opening in a sidewall thereof aligned with said outlet header by-pass opening and said hollow member has end portions sealingly disposed within said openings.

3. A heat exchanger as set forth in claim 2 wherein one of said inlet and outlet headers has another by-pass opening and one of said end portions of said hollow member also extends through said another by-pass opening.

4. A heat exchanger as set forth in claim 3 wherein selected ones of said outlet header by-pass opening, said at least one by-pass opening and said another by-pass opening are provided with outwardly projecting peripheral collar portions adapted to be sealingly secured to said hollow member.

5. A heat exchanger as set forth in claim 4 wherein said opening means comprises an opening provided in said one of said end portions of said hollow member and said closure means comprises plug means removably engaging said one of said end portions to seal said hollow member.

6. A heat exchanger as set forth in claim 5 wherein said one end of said hollow member is threaded and said plug means comprises a threaded plug.

7. A heat exchanger as set forth in claim 5 wherein said one end of said hollow member has a nipple secured thereto and said plug threadedly engages said nipple in sealing relationship.

8. A heat exchanger as set forth in claim 5 wherein said one end of said hollow member has a pair of diametrically opposed openings, said plug has a diametric passage extending therethrough and is retained in sealing engagement with said hollow member by a pin extending through said diametric openings and passage.

9. An oil cooler of the fin and tube type comprising:

an inlet header having a first opening adapted to be connected to fluid supply means, and a pair of diametrically opposed openings adjacent one end thereof;

an outlet header having a first opening adapted to be connected to said fluid supply means and a second opening adjacent one end thereof;

a plurality of finned fluid conduits extending between and interconnecting said inlet and outlet headers in fluid communication;

a continuous one piece fluid by-pass conduit having one end sealingly disposed in said second opening of said outlet header, another end extending through said opposed openings of said inlet header, and at least one opening adjacent said another end and operative to place said fluid conduit in fluid communication with said inlet header;

stop means disposed within said fluid by-pass conduit;

a pressure relief valve removably disposed within said fluid by-pass conduit between said inlet and outlet headers and operative to allow fluid flow through said fluid by-pass conduit in response to a predetermined pressure differential between said inlet and said outlet headers;

removable closure means for sealing said another end; and resilient means for urging and retaining said pressure relief valve in engaging relationship with said stop means.

10. An oil cooler as set forth in claim 9 wherein said pair of diametrically opposed openings are provided with outwardly projecting peripheral collar portions adapted to sealingly engage said fluid by-pass conduit.

11. An oil cooler as set forth in claim 10 wherein said removable closure means comprises a threaded portion provided on said another end of said fluid by-pass conduit and a threaded plug engaging said threaded portion.

12. An oil cooler as set forth in claim 11 wherein said resilient means comprises a spring partially compressed between said plug and said pressure relief valve.

13. An oil cooler as set forth in claim 11 wherein said removable closure means comprises a pair of diametrically opposed openings provided adjacent said another end of said fluid by-pass conduit, a plug having a diametric passage extending therethrough, said plug being of a size to fit snugly within said another end of said fluid by-pass conduit and a pin member cooperating with said diametrically opposed openings and said diametric passage to retain said plug within said another end.

14. An oil cooler as set forth in claim 13 wherein said second opening of said outlet header is also provided with a peripheral collar adapted to be sealingly secured to said fluid by-pass conduit.

15. An oil cooler as set forth in claim 14 wherein said fluid by-pass conduit is sealingly secured to said peripheral collars by brazing.

16. An oil cooler as set forth in claim 13 wherein said fluid by-pass conduit has an interior cross-sectional area greater than each of said plurality of finned fluid conduits.

17. An oil cooler as set forth in claim 16 wherein said fluid by-pass conduit is cylindrical in shape.

18. An oil cooler as set forth in claim 17 wherein said inlet and outlet headers are cylindrical and of a diameter greater than said fluid by-pass conduit.

19. In a heat exchanger having an inlet header, an outlet header, a core assembly comprising a plurality of restricted fluid passageways extending between said inlet and outlet headers, and heat radiating fins surrounding said plurality of fluid passageways, an integral pressure responsive by-pass means comprising:

an elongated one piece hollow member having one end secured in fluid communication with one of said inlet and outlet headers and the other end extending through the other of said inlet and outlet headers and including passage means for placing said other end of said hollow member in fluid communication with said other of said inlet and outlet headers;

stop means provided within said hollow member between said inlet and outlet headers;

a self-contained pressure relief valve means disposed entirely within said hollow member and between said inlet and outlet headers, said pressure relief valve being operative to allow fluid flow between said inlet and outlet headers in response to a predetermined pressure differential therebetween;

closure means removably secured to said other end of said hollow member; and resilient biasing means extending between said closure means and said pressure relief valve and operative to bias and retain said pressure relief valve in engagement with said stop means.

20. A heat exchanger as set forth in claim 19 wherein said inlet and said outlet headers are provided with openings through which said hollow member extends and at least one of said openings is provided with an outwardly projecting peripheral collar portion adapted to be sealingly secured to said hollow member.

21. A heat exchanger as set forth in claim 20 wherein said collar portion is integrally formed on at least one of said inlet and outlet headers.

22. A heat exchanger as set forth in claim 19 wherein said closure means comprises plug means removably engaging said one of said end portions to seal said hollow member.

23. A heat exchanger as set forth in claim 19 wherein said one end of said hollow member is threaded and said plug means comprises a threaded plug.

24. A heat exchanger as set forth in claim 19 wherein said one end of said hollow member has a nipple secured thereto and said plug threadedly engages said nipple in sealing relationship.

25. In a heat exchanger as set forth in claim 19 wherein said stop means comprises a flat member having a central opening provided therein and a peripheral surface secured to said hollow member.

26. In a heat exchanger as set forth in claim 19 wherein said stop means comprises a peripheral indentation formed on said hollow member.

* * * * *